US010577164B2

(12) United States Patent
Siskron, III et al.

(10) Patent No.: US 10,577,164 B2
(45) Date of Patent: Mar. 3, 2020

(54) TOY PACKAGING AND DISPLAY DEVICE AND METHOD OF ASSEMBLY

(71) Applicants: F. Thomas Siskron, III, Shreveport, LA (US); Rodney Hoffman, Ramona, OK (US)

(72) Inventors: F. Thomas Siskron, III, Shreveport, LA (US); Rodney Hoffman, Ramona, OK (US)

(73) Assignee: TIII Ventures, LLC, Shreveport, LA (US)

( * ) Notice: Subject to any disclaimer, the term of this patent is extended or adjusted under 35 U.S.C. 154(b) by 229 days.

(21) Appl. No.: 15/500,122

(22) PCT Filed: Jul. 31, 2015

(86) PCT No.: PCT/US2015/043088

§ 371 (c)(1),
(2) Date: Jan. 30, 2017

(87) PCT Pub. No.: WO2016/022416

PCT Pub. Date: Feb. 11, 2016

(65) Prior Publication Data

US 2017/0275072 A1 Sep. 28, 2017

(51) Int. Cl.

| | |
|---|---|
| ***B65D 77/04*** | (2006.01) |
| ***B65D 77/22*** | (2006.01) |
| *A45C 11/12* | (2006.01) |
| *A45C 11/16* | (2006.01) |

(52) U.S. Cl.
CPC ..... *B65D 77/0486* (2013.01); *B65D 77/22* (2013.01); *A45C 11/12* (2013.01); *A45C 11/16* (2013.01)

(58) Field of Classification Search
CPC .... B65D 77/0486; B65D 77/22; B65D 25/10; B65D 5/5213; B65D 1/24; A45C 11/12; A45C 11/16; A47G 23/00
USPC ..... 206/765, 216, 217
See application file for complete search history.

(56) References Cited

U.S. PATENT DOCUMENTS 3,156,279 A 11/1964 Grebowiec et al.
5,261,848 A * 11/1993 Kaplan ..... A63H 3/50 220/662
5,291,674 A * 3/1994 Torrence ..... G09F 19/02 40/410
5,318,183 A 6/1994 Cohen et al.
5,769,680 A * 6/1998 Hoffman ..... A47G 19/2227 206/217
5,881,868 A * 3/1999 Soyak ..... A24F 15/00 206/213.1
5,996,781 A * 12/1999 Glaser ..... A47G 19/2227 206/217

(Continued)

*Primary Examiner* — Chun Hoi Cheung
*Assistant Examiner* — Brijesh V. Patel
(74) *Attorney, Agent, or Firm* — Robert Devin Ricci; Lauren J. Rucinski; Kean Miller LLP

(57) ABSTRACT

A toy packaging and display device such as for use with a toy or a prize is provided. The device generally comprises a base unit, an internal display sleeve, and an external packaging, wherein the toy or prize is housed in a chamber or cavity formed between the internal display case and the base unit and wherein the internal display case is housed at least partially within the external packaging. The external layer of the toy packaging and display device will preferably resemble a can such as a soda can.

18 Claims, 5 Drawing Sheets

(56) References Cited

U.S. PATENT DOCUMENTS

| | | | | |
|---|---|---|---|---|
| 6,027,774 | A * | 2/2000 | Fine | G09F 19/02 40/406 |
| 6,085,927 | A * | 7/2000 | Kusz | B65D 77/0493 215/6 |
| 6,648,132 | B1 * | 11/2003 | Smouha | A45C 11/12 206/301 |
| 6,953,118 | B2 * | 10/2005 | Seno | B65D 5/22 206/485 |
| 7,527,542 | B2 * | 5/2009 | Collins | A63F 7/045 40/406 |
| 8,069,860 | B2 * | 12/2011 | Soyak | A24F 15/00 131/329 |
| 8,992,281 | B2 * | 3/2015 | Lui | A63H 3/50 446/72 |
| 2001/0032795 | A1 * | 10/2001 | Weinstein | B65D 11/02 206/321 |
| 2002/0090879 | A1 * | 7/2002 | Galomb | A63H 3/005 446/73 |
| 2009/0127269 | A1 * | 5/2009 | Wengrovsky | A47G 19/02 220/575 |
| 2012/0091030 | A1 * | 4/2012 | Paschke | B65D 11/10 206/723 |

* cited by examiner

TOY PACKAGING AND DISPLAY DEVICE AND METHOD OF ASSEMBLY

CROSS REFERENCE TO RELATED APPLICATIONS

This application is the National Stage of International Application No. PCT/US15/43088, filed Jul. 31, 2015, which claims the benefit of U.S. patent application Ser. No. 62/032,760, filed Aug. 4, 2014, which is hereby incorporated by reference in its entirety.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

BACKGROUND

Packaging is a large concern for many manufacturers and promoters. This general concern is particularly troublesome to those involved in the toy industry that is constantly looking for new and innovative packaging techniques to reduce waste, decrease shelf-imprint, and provide a new experience to potential consumers or collectors. For example, bulky packaging results in a reduction of inventory to available shelf space. Packaging of varying shapes and sizes likewise presents an issue with both stocking inventory and with distributing the inventory to potential consumers. Boxes are often used to create a more uniform shape; however, they are often overly bulky and create a needless waste of space. Varying shapes of toy packaging essentially prevent the cost-effective distribution of toys and other prizes through automated machines as the spacing in the machines must be large enough to accommodate the various sizes.

A need has been presented for a new means of packaging which would solve one or more of the following problems: 1) packaging which can adequately protect the contents of the packaging without adding excess bulk, thereby requiring the package to occupy superfluous shelf space in a retail market, 2) packaging which allows potential consumers the option to see the contents of the package without disturbing the contents themselves, 3) packaging which allows a consumer or collector to preserve the contents of the packaging after purchase, 4) packaging that allows a potential consumer to access the contents contained therein without materially disturbing the packaging, thereby allowing the consumer to see and display the contents without damaging the toy or prize contained therein and/or 5) packaging which will allow for a uniform distribution of the various contents capable of being contained in the packaging. A toy packaging and display device is presented through one or more embodiments herein to solve these and other issues.

SUMMARY

Embodiments of a toy packaging and display device are presented herein to solve one or more of the aforementioned needs. Thus, embodiments of the toy packaging and display device will be disclosed that offer dual layer protection to the toy or prize housed within the device. In so doing, the device not only provides an external packaging which is useful in terms of protecting the contents for retail sale and distribution while minimizing shelf space, but it is also useful to the end user (i.e., the consumer or collector) for long term storage and protection such as may be desired for a collectible toy or prize. Traditionally, collectors do not open the packaging of collectible toys for fear of damaging the products. A user desiring to maintain the integrity of the toy or prize contained in an embodiment of the current invention could remove the external casing, thereby exposing the at least partially transparent display case containing the toy or prize. This allows a complete display of the contents without damaging the toy or prize, the display case, or the external packaging, which can all be reassembled together into a complete unit as desired by the user or salesperson.

To accomplish this goal, a packaging and display device is described which comprises generally a base unit, an internal display case, and external packaging separable from the internal display case. In one or more embodiments, a packaging and display device is provided in which an external packaging can be removably attached to an at least partially transparent display case in such a manner that the display case is substantially housed within a first internal cavity defined at least in part by the external packaging. In various embodiments, the external packaging is either directly attached to the display case or indirectly to the display case through another component or series of components, including but not limited to the base unit. The display case is also connected to a base unit, thereby defining a second cavity, diametrically smaller than the first, which is capable of housing the desired contents of the packaging (typically a toy or prize) and display case. The contents envisioned for the present packaging and display case typically comprise toys or prizes; however, numerous uses of a packaging and display case, as disclosed herein, could be conceived. Furthermore, the external packaging can be defined to a conventional shape, such as one for a soda can, to allow consumers to readily identify the product. Additionally, by using conventional shaped packaging in a wholly new manner (i.e., a packaging for toys or prizes), store clerks would readily understand the best means for stocking the products in a space efficient manner. Moreover, the use of certain shapes may additionally allow for distribution in new and unconventional distribution channels for toys or prizes. For example, toys are not typically distributed through automated vending machines outside of the quarter-turn crank machines. However, an additional feature of the present invention is the adaptability of the toy packaging and display case to allow for its distribution through conventional automated machines, such as drink machines.

Therefore, in at least one embodiment, the toy packaging and display device comprises:

1. Base unit;
2. An internal display case capable of removably mating with said base unit;
3. An external sleeve diametrically larger than the internal display case;

Wherein the external sleeve is capable of removably mating with said base unit; wherein a first cavity is defined between said external sleeve and said base unit such as to house said display case; and wherein a second cavity is defined between said display case and said base unit such that a toy or prize is capable of being housed in said second cavity.

In such an embodiment, the external packaging comprises an external sleeve. However, the external packaging may or may not comprise additional components depending on the particular embodiment. For example, in various embodiments, the external packaging could comprise advertising materials, barcodes and/or labels applied to the external surface of the sleeve, reinforcing means, a top, or other conceivable additions. Additionally, the external packaging can be made of numerous materials, which may change depending on the intended usage, intended distribution channels, and the aesthetic looks. For this reason, examples of potential materials for the external sleeve components include, but are not limited to, plastics, woods, malleable metals such as tin and aluminum, cardboard, paper, paperboard or combinations thereof.

Additionally, the external sleeve can comprise numerous three-dimensional shapes, such as prisms of various shapes, cubes, tetrahedrons, pyramids, cylinders, cones, spheres, and shapes corresponding with conventional items like soda cans, so long as it is capable of defining a first cavity when it is removably attached to the base unit. It would be preferable that the base unit correspond in shape to an opening in the external sleeve. For example, in at least one embodiment, the external sleeve is cylindrical in shape with an opening on at least one side, the base unit has a cross section that is circular in shape, and the base unit is capable of removably mating with the external sleeve at the opening. Alternatively, the external sleeve is cylindrical in shape with an opening on both ends, is removably attachable to a circular base unit, and may or may not be removably attachable to a circular top unit such that an enclosed cavity is formed between said external sleeve, the base unit and the top when all are attached. In such an embodiment, an external packaging is formed when the external sleeve is attached to the base unit and top unit. For example, in one or more embodiments, the external packaging is shaped to resemble a soda can.

In numerous embodiments, the base unit serves a dual purpose to close an opening in both the external packaging and the display case. Therefore, the base unit has the potential to act in defining two cavities: a first cavity is formed between the base unit and the external packaging which is large enough to house substantially all of the display unit, and a second cavity is defined between the base unit and the display case which is substantially sized to house an intended toy or prize. The base unit can comprise a number of materials such as plastics, metals, papers, and cardboard. In one or more embodiments, the base unit is formed out of plastic and the base unit directly connects to the display unit. In alternate forms of these embodiments, the base unit further comprises ridges which correspond to the general shape of the display unit to aid in creating a friction fit between the two.

The external sleeve and base unit, and the display case and base unit, can both be attached through several means, including both mechanical and non-mechanical means, or a combination of mechanical and non-mechanical means. Additionally, as described herein, both the external sleeve and the display case may be removably attachable to the base unit, indirectly attaching the display case to the external sleeve when so desired by a user.

In at least one additional embodiment, the toy packaging and display device comprises:

a. a base unit, wherein the base unit comprises an external portion and an ascending portion, wherein the external portion is diametrically larger than the ascending portion;

b. a display case comprising an at least partially translucent wall, wherein said display case is capable of mating with said base unit forming a display case unit;

c. an external sleeve, wherein the external sleeve comprises an external sleeve wall and a top, wherein said external sleeve is capable of mating with said base unit thereby forming an external package;

d. wherein a first cavity is defined between said external sleeve and said base unit such as to house said display case; and wherein a second cavity is defined between said display case and said base unit such that a toy or prize is capable of being housed in said second cavity.

DESCRIPTION OF THE DRAWINGS

The drawings constitute a part of this specification and include exemplary embodiments of the toy packaging and display device, which may be embodied in various forms. It is to be understood that in some instances, various aspects of the invention may be shown exaggerated or enlarged to facilitate an understanding of the invention. Therefore the drawings may not be to scale.

DETAILED DESCRIPTION

The subject matter of the present invention is described with specificity herein to meet statutory requirements. However, the description itself is not intended to necessarily limit the scope of claims. Rather, the claimed subject matter might be embodied in other ways to include different components or combinations of components similar to the ones described in this document, in conjunction with other present or future technologies.

Furthermore, the described features, structures, or characteristics may be combined in any suitable manner in one or more embodiments. In the following description, numerous specific details are provided, such as examples of materials, attachment means, components, and configurations. One skilled in the relevant art will recognize, however, that the toy packaging and display device may be practiced without one or more of the specific details, or with other methods, components, materials, and so forth. In other instances, well-known structures, materials, or operations are not shown or described in detail to avoid obscuring aspects of the invention.

Figure 1:
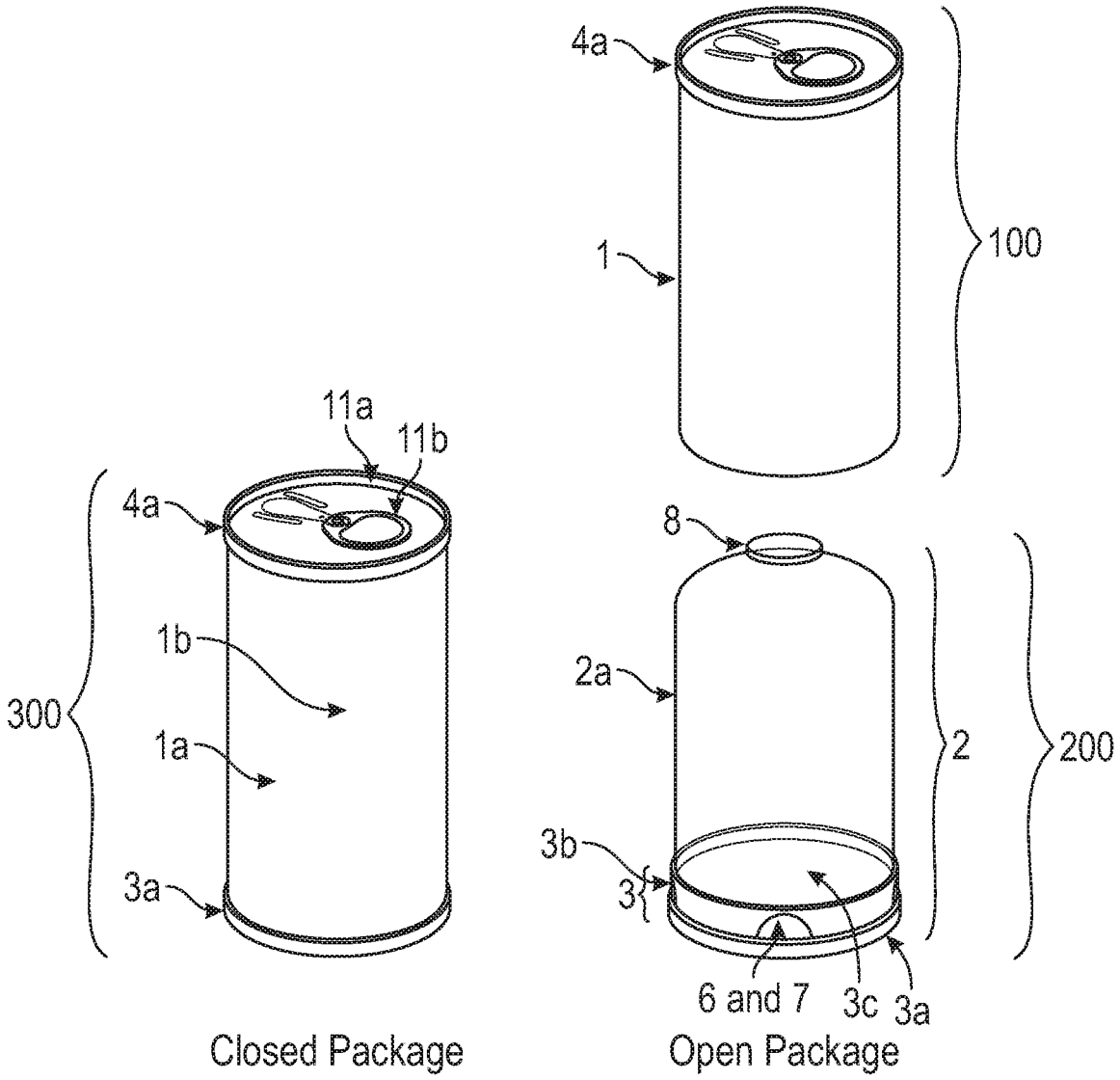
FIG. 1 is an image which displays the comparison of the toy packaging and display device in a closed package state, as shown on the left, and an open package state on the right wherein the external sleeve has been separated from the base unit and display case and wherein the overall external sleeve unit is in the shape of a conventional can, such as a soda can.

Turning first to FIG. 1, a toy packaging and display device is shown in a closed package view (left) and an open package view (right). As further shown in FIGS. 1 and 3, a toy packaging and display device for packaging and displaying a toy or prize is described herein in greater detail comprising, generally, an external packaging 100, a display case 2, and a base unit 3. External packaging 100 is removably attachable to base unit 3 so as to create closed package unit 300 when attached. Display case 2 is likewise removably attachable to base unit 3 so as to create display case unit 200 when attached. As noted, both the external packaging 100 and display case 2 are each removably attachable to base unit 3 such that a first cavity is defined by closed package unit 300 which is capable of housing display case 2 when closed package unit 300 is assembled and the toy packaging and display device is in the closed position. Furthermore, a second cavity is defined by display case unit 200 in which a toy or prize 9 can be housed as further depicted in FIG. 2.

Figure 2:
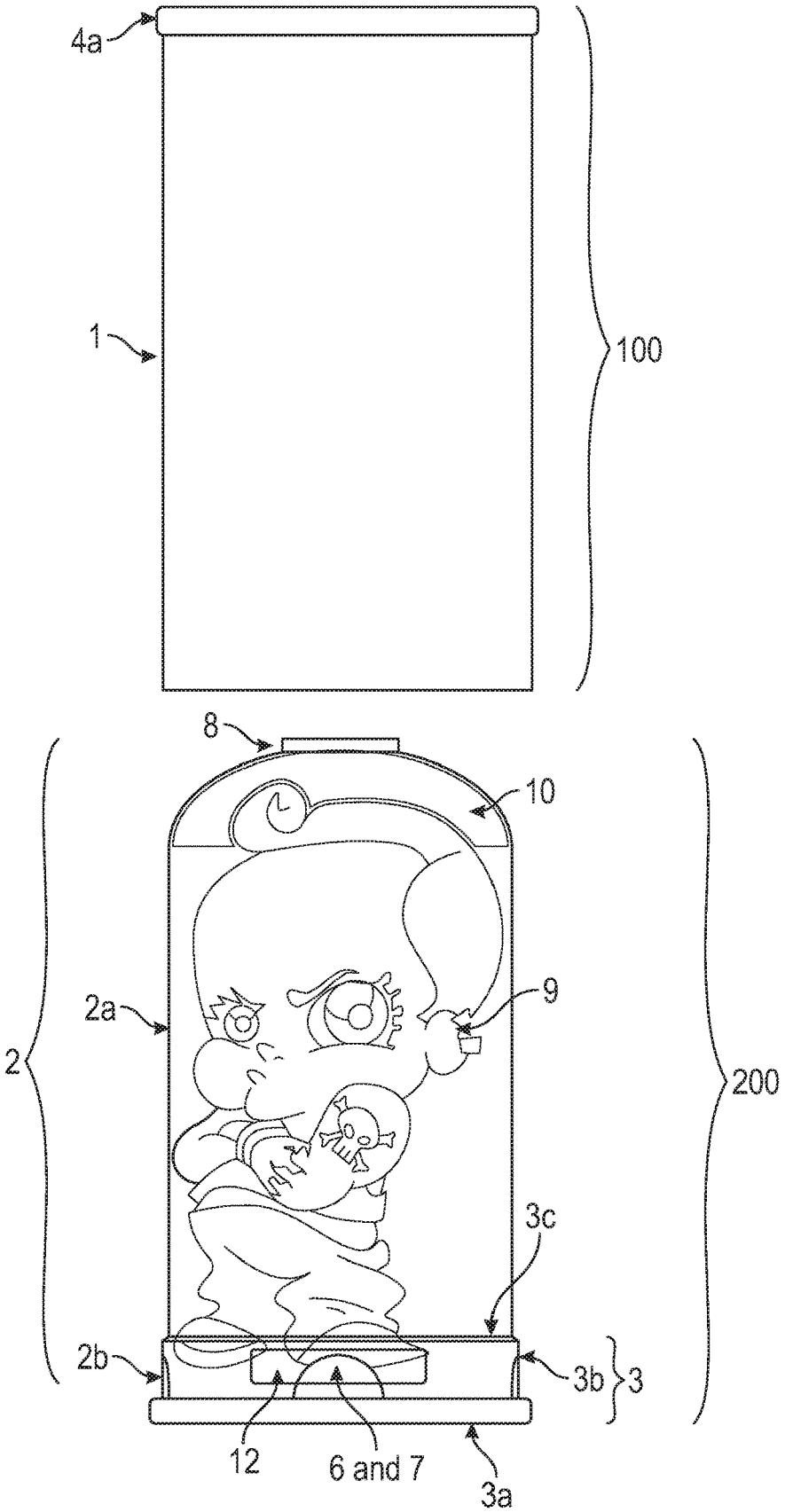
FIG. 2 is a schematic view of the open package depiction of the toy packaging and display device of FIG. 1 disclosing the component parts of the device wherein a toy or prize is located within the cavity formed between the base unit and the display case.

Turning to FIG. 2, an assembled display case unit 200 is depicted wherein the external packaging has been telescopically removed from base unit 3 so as to allow the display of toy or prize 9 housed inside the cavity defined by display case unit 200. As depicted, toy or prize 9 is a doll-like toy for illustrative purposes only. A person having ordinary skill in the art would readily recognize that any number of toy types and shapes would be capable of and desirable of being housed inside the display case unit 200 as shown herein. For example, toy or prize 9 could include, but should not be limited to, dolls, trinkets, action figures, stuffed animals, models, vehicular themed toys, remote control toys, currency, coupons, prize tickets, certificates, awards, and other toys and prizes.

Figure 3:
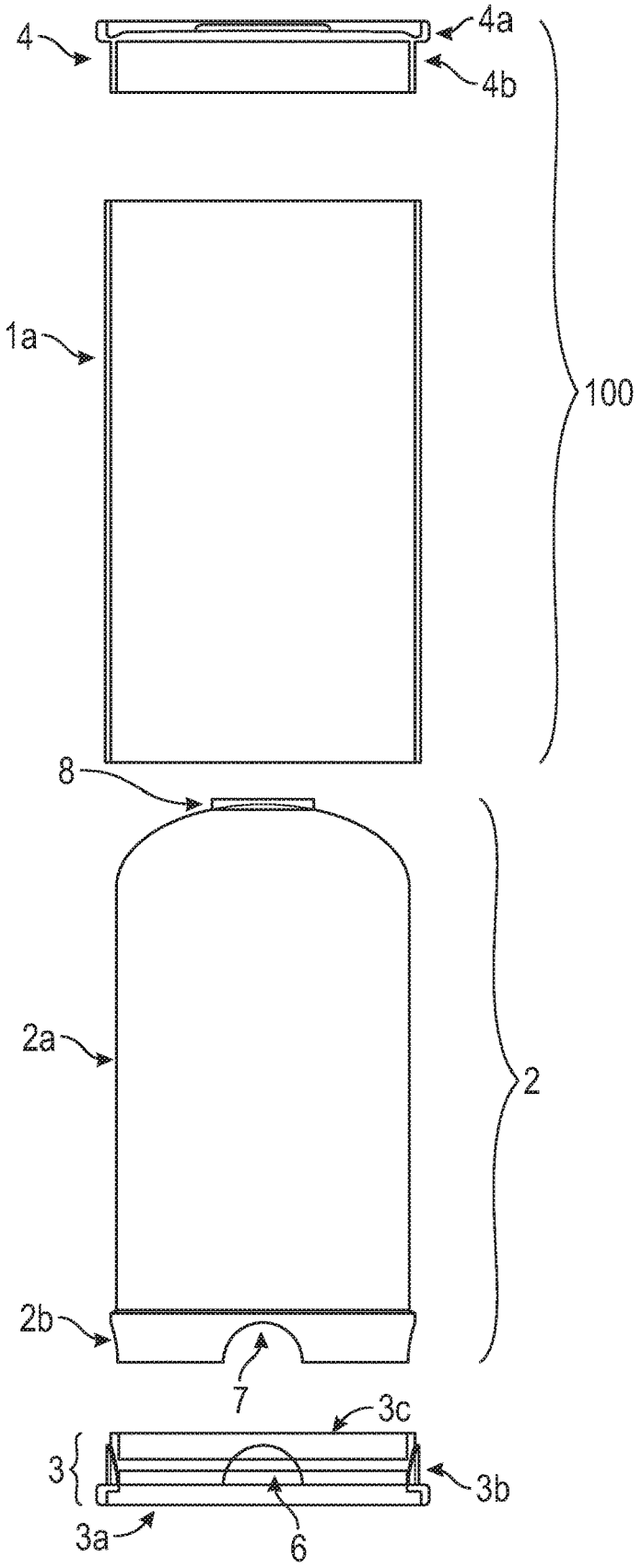
FIG. 3 is a schematic view of the components of the packaging and display device wherein the top, external sleeve, display case, and base unit have been telescopically separated to portray several components of the particular embodiment.

Turning now to FIG. 3, a blown up depiction of the present embodiment is provided without showing toy or prize 9 in order to illustrative potential component parts of the toy packaging and display device. Generally, the structural components of the toy packaging and display device as depicted comprise an external packaging 100, a display case 2, and a base unit 3. External packaging 100 comprises external sleeve wall 1 and top unit 4 which are either removably or permanently attached together. External sleeve wall 1 can be formed out of one or more pieces. As depicted, external sleeve wall 1 is formed out of a single piece of material shaped to form the walls of a hollow cylindrical or tubular column. External sleeve wall 1 may be constructed from a number of materials including plastics, woods, malleable metals such as tin and aluminum, paper, paperboard or cardboard. In various embodiments, the external sleeve could be at least partially transparent, thereby allowing the contents to be viewable even when closed, or at least partially opaque, thereby preventing harmful sunlight or other UV rays from contacting toy or prize 9 when it is housed inside the external sleeve, preventing the rays from damaging or fading the paint on toy or prize 9. It is preferable, but not necessary, that external sleeve wall 1 be constructed from a material or in a manner such that it is capable of maintaining its general cylindrical or tubular form when external packaging 100 is not attached to base unit 3, allowing the external sleeve to be easily removed from and re-attached to base unit 3. As depicted in the Figures, external sleeve wall 1 is extruded from plastic to be tubular in shape with an internal wall, an external wall, and two open ends. However, as previously discussed, alternate embodiments can be made wherein the external sleeve wall is formed from a number of different materials. Thus, for example, external sleeve wall 1 could be formed from a roll of cardboard which has been secured in a fashion known in the art (such as through the use of an adhesive) to maintain the desired cylindrical shape of the depicted embodiment.

Top unit 4 comprises: 1) a top external layer 4*a* which forms the top external layer substantially sealing one open end of external sleeve wall 1 when top unit 4 is mated with external sleeve wall 1, and 2) a top depending section 4*b* which depends at a substantially 90 degree angle from top external layer 4*a* into one of the openings of external sleeve wall 1 and substantially contacts the internal wall of external sleeve wall 1. Top unit 4 can be attached to external sleeve wall 1 thus forming external packaging 100 through several means which can include mechanical attachment means, non-mechanical attachment means, or a combination of both mechanical and non-mechanical attachment means. For example, depending on whether or not the attachment is to be removable or permanent, an attachment means could be selected from friction-fitting, compression fitting, thermal sealing, tabs, adhesives, zips, ties, snaps, screws, clamps, threaded fittings, and the like.

In the embodiment as depicted, top unit 4 is permanently attached to the external sleeve wall 1 thereby forming a single external packaging 100. To accomplish this desired configuration, top depending section 4*b* can be shaped so as to fit within and contact the internal wall of the external sleeve wall 1. Thus, as depicted, top depending section 4*b* has a cross section that is substantially circular in shape to correspond with the circular opening in the cylindrical external sleeve wall 1. In such an embodiment, the top depending section 4*b* may be cylindrical in shape. Additionally, top depending section 4*b* is slightly smaller diametrically than the opening in the external sleeve wall 1, thereby causing the surface of the top depending section 4*b* to come into contact with the internal wall of the external sleeve wall 1 forming a partial pressure or friction fit between the two components. An adhesive such as glue is applied between the top depending section 4*b* and the corresponding location on the internal wall of the external sleeve wall 1 and allowed to cure.

Top external layer 4*a* is the section opposite the top depending section 4*b* and forms an external layer of the external packaging 100 when the top unit 4 is connected to the external sleeve wall 1. Top external layer 4*a* can be marked with moldings or writings which match the general theme of the external appearance. For example, as depicted in FIG. 1, closed package unit 300 resembles a soda can. Therefore, top external layer 4*a* comprises molded indicia 11*b* in the shape of a pop top and written indicia 11*a* noting the name of a soda or the soda themed contents of the container.

In an alternate embodiment, external packaging 100 can be formed from a single piece such as an extruded plastic. Such an embodiment would effectively remove the need to create separate units for external sleeve wall 1 and top unit 4 as they would be formed from a single unit. The attachment means used to attach top unit 4 to external sleeve wall 1 would likewise not be necessary under such an embodiment.

Display case 2 comprises display case shell 2*a* and display case base unit receptor 2*b*. As depicted in FIG. 3, display case shell 2*a* comprises an at least partially transparent wall panel which is substantially tubular in shape, with an open end and a closed end which is substantially dome-shaped. One having ordinary skill in the art would readily recognize that the closed end could have a number of shapes other than dome-shaped. Likewise, the shape of the display case or the shape of the display case shell can come in multiple forms as long as at least a portion thereof is capable of being housed within the external packaging 100 and is capable of housing at least a portion of the intended toy or prize 9. Typical examples might include, but should not be so limited to, prisms of various shapes, cubes, tetrahedrons, pyramids, cylinders, cones, spheres, and shapes corresponding with conventional items. Display case base unit receptor 2*b* is the connecting portion of the display case 2, located near the open end of display case shell 2*a*. As depicted, display case base unit receptor 2*b* is an enlarged slot shaped so as to mate with a corresponding part (ascending base unit structure 3*b*) on base unit 3. Thumb tab receptor 7 is a groove or series of grooves formed into display case base unit receptor 2*b* which mates with base thumb tab 6 (or thumb tabs) located on base unit 3. The use of the thumb tab 6 and thumb tab receptor 7 allow for a user to more easily align the top when closing the display case 2 and to open the top when desired.

As depicted, display case shell 2*a* and display case base unit receptor 2*b* are formed from one piece of plastic and form one unit. However, it is possible for display case shell 2*a* and display case base unit receptor 2*b* to be separate units which are attached to each other so as to form display case 2.

In order to fit within the external packaging 100, the display case 2 has a height that is shorter than that of external sleeve wall 1. It is desirable in many embodiments for the display case 2 to fit substantially snugly inside the closed package unit 300. In order to account for the differences in height and to secure the display case 2 and its contents into the closed package unit 300, a support spacer 8 may be utilized which contacts both the inside wall of the closed package unit 300 and the display case 2. As depicted, support spacer 8 is a cylindrical piece of plastic formed to the top of the display case 2 which comes into contact with the internal wall of top external layer 4*a*. However, support spacer 8 can comprise any number of shapes and materials and need not be directly connected or formed to the display case 2. Additional, support spacers may be used on the sides of the display case 2 as well if needed or desired in a particular design.

Figure 4:
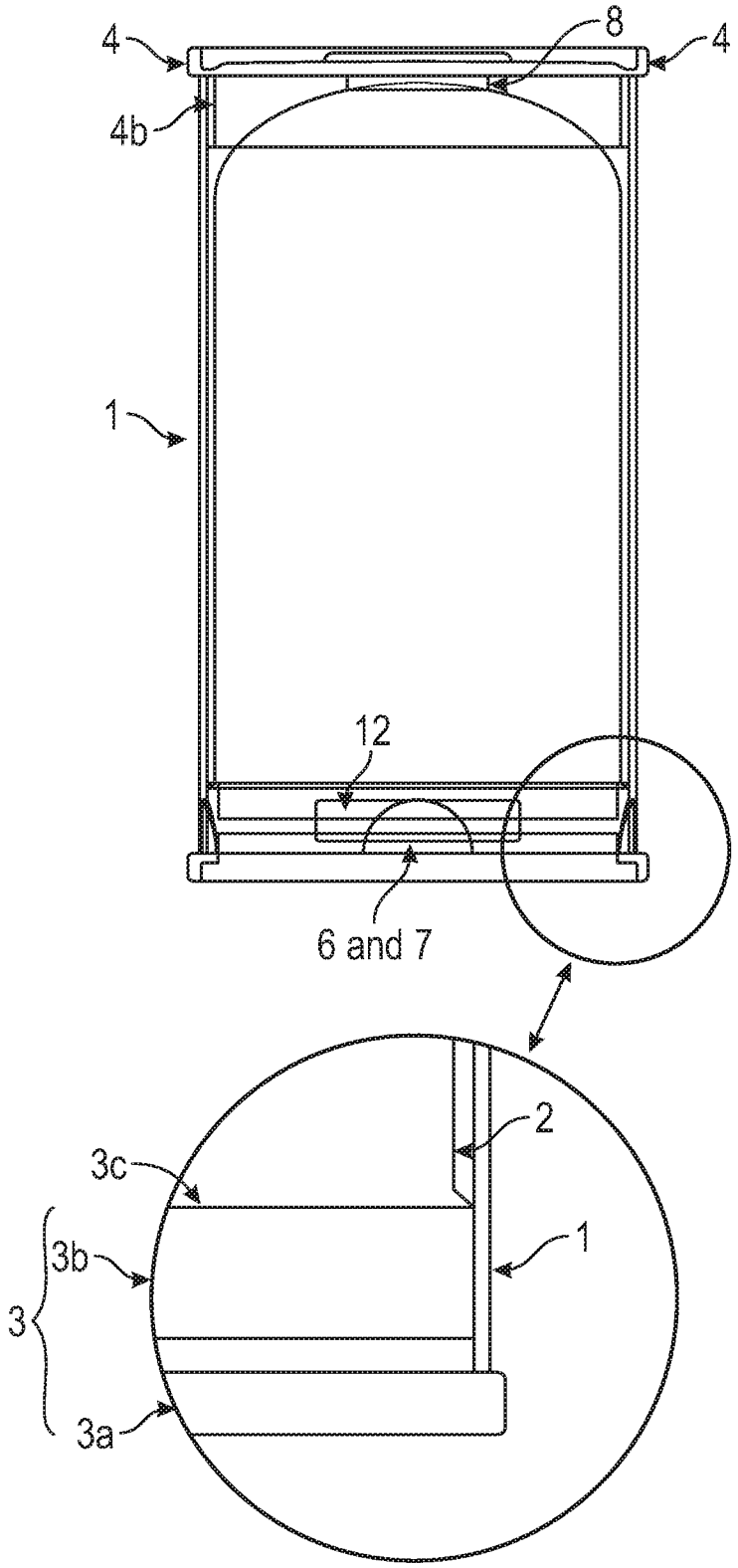
FIG. 4 is a frontal view of the display case housed inside external packaging with an enlarged view showing the interaction between the base unit of the display case and the external packaging.
Figure 5:
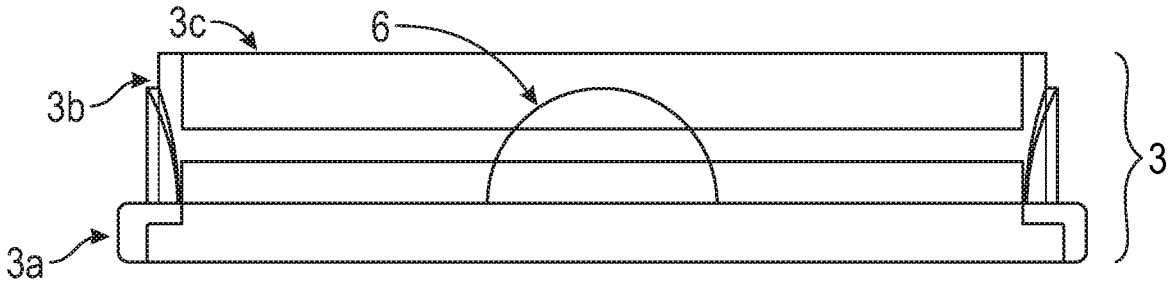
FIG. 5 is a frontal view of the base unit.
Figure 6:
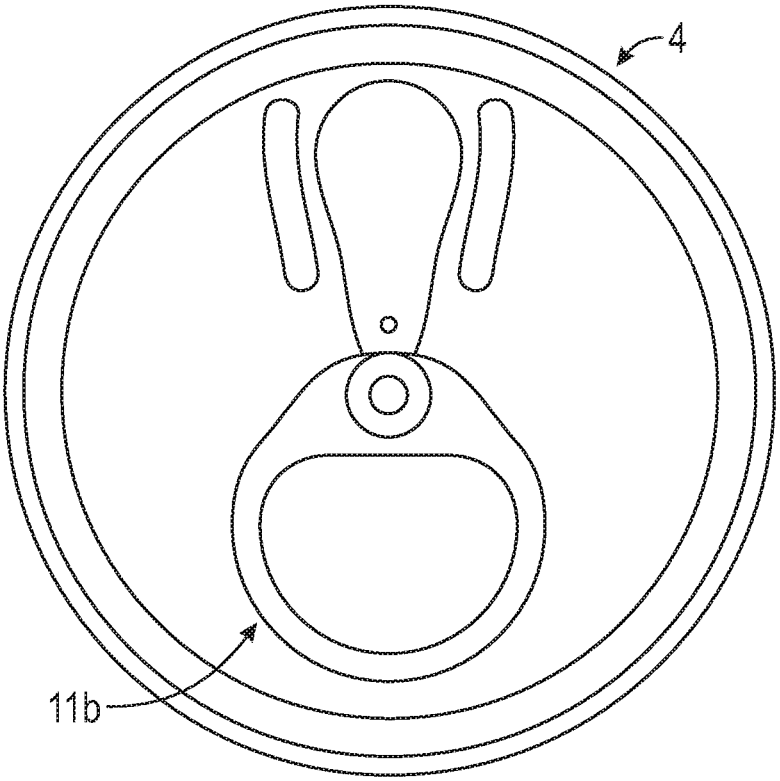
FIG. 6 is a top view of the external packaging showing examples of indicia displayed on the external packaging.

Turning to FIG. 4, a cross section of a closed device is shown with an enlarged or blown up view of the base unit 3. In the depicted embodiment, base unit 3 has a cross section that is generally circular in shape, but can be any number of shapes so long as it is capable of pairing with the corresponding components of the display case 2 and external packaging 100 to which it mates. Base unit 3 comprises external base layer 3*a* which acts as an external layer to both the display case unit 200 and the closed package unit 300, ascending base structure 3*b* which at least partially ascends from external base layer 3*a* into the display case 2 when the display case unit 200 is formed, and base unit platform 3*c*. Ascending base structure 3*b* is diametrically smaller than external base layer 3*a*, such that display case 2 and external packaging 100 are both capable of contacting the interior side of external base layer 3*a*. The top external layer 4*a* of ascending base structure 3*b* is base unit platform 3*c* which is generally a flat platform opposite base unit 3. The base unit 3 further comprises at least one protrusion such as base thumb tab 6 on or near ascending base structure 3*b* which correspond to and mate with thumb tab receptor 7 as previously discussed.

Assembly of the Device Containing a Toy

Solely for the purposes of properly illustrating an enabling means by which a Toy Packaging and Display Device can be assembled, a set of assembly instructions are provided herein commencing from the inside of the device and working outwards. Indeed, any number of combinations for an assembly can be used and the assembly means discussed herein may and will likely need to be modified as assembly and manufacturing concerns dictate.

Under one means of assembling an embodiment of the Toy Packaging and Display Device containing a toy or prize, a toy or prize 9 is placed on base unit platform 3*c* which is diametrically larger than the diameter of the toy or prize 9. A securing tray 10 which is designed to substantially span a gap between toy or prize 9 and display case 2 is placed into contact with toy or prize 9. As depicted in FIG. 2, securing tray 10 can be molded so as to substantially mate with the shapes of at least a portion of either or both toy or prize 9 and display case 2. Although not depicted in the Figures, alternate embodiments may use additional securing trays or alter the location of the securing tray 10 so as to mate with the sides or top of the display case 2 or with the base unit 3. Once the securing tray 10 is in place, display case 2 is lowered around toy or prize 9 and onto base unit 3 wherein display case 2 is removably attached to base unit 3 forming display case unit 200. Display case 2 and base unit 3 can be attached via mechanical attachment means, non-mechanical attachment means, or a combination of both mechanical and non-mechanical attachment means. For example, depending on whether or not the attachment is to be removable or permanent, an attachment means could be selected from friction-fitting, compression fitting, thermal sealing, tabs, adhesives, zips, ties, snaps, screws, clamps, threaded fittings, and the like.

In an embodiment such as those depicted in the Figures, display case 2 is lowered in a manner such that base thumb tab receptor 7 and base thumb tab 6 substantially mate. Once the display case 2 is properly aligned or mounted onto base unit 3, security tape 12 is attached to the display case unit 200 such that it spans across at least part of both the display case 2 and base unit 3.

Alternatively, securing tray 10 can be placed directly into the display case 2, toy or prize 9 can be inserted into the display case 2 wherein it will come into contact with securing tray 10. Once toy or prize 9 is in display case 2, base unit 3 can then be removably mated to display case 2, forming display case unit 200.

As shown in FIGS. 2 and 4, a pre-assembled external packaging 100 is generally used when assembling the device such that it can easily be lowered around display case 2 and removably connected to base unit 3. To assemble external packaging 100, external sleeve wall 1 is formed from an extruded plastic or other material, such as a roll of cardboard which has been formed into the desired shape. Top unit 4 is attached either permanently or removably attached to external sleeve wall 1. For non-limiting, illustrative purposes only, top unit 4 can be permanently attached to external sleeve wall 1 by: 1) applying adhesive to top unit depending section 4*b* and at least a portion of the internal wall of external sleeve wall 1, and 2) mating top unit 4 with external sleeve wall 1 such that top depending section 4*b* depends into external sleeve wall 1 and substantially contacts the internal wall of external sleeve wall 1 such as to allow the adhesive to connect the two components. External indicia 1*a* can either be added to the external layer of external sleeve wall 1 before or after assembly of the external packaging 100. As depicted in FIG. 1, external indicia 1*a* is a sheet of paper upon which a design is printed. External indicia 1*a* is wrapped around external sleeve wall 1 such that one end of external indicia 1*a* contacts and overlaps with the opposing end of external indicia 1*a* at overlap 1*b*. A layer of adhesive is placed onto at least one end of external indicia 1*a* such that the two ends are connected at overlap 1*b*.

Turning specifically to FIG. 2, once assembled, external packaging 100 is lowered around display case 2 and onto base unit 3. External packaging 100 is then removably attached to base unit 3 via the various means discussed herein, forming closed package unit 300 which is ready for distribution or sale to consumers or collectors. As desired, additional security measures such as the application of security tape 12 to the point of connection between external packaging 100 and base unit 3 may be applied. In other uses, no security measures will be applied to the connection, allowing potential consumers or collectors to open the packaging and view the toy or prize 9 contained therein.

For the purpose of understanding the toy packaging and display device, references are made in the text to exemplary embodiments of a toy packaging and display device, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the toy packaging and display device may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change to the basic function to which it is related.

PARTS LIST

No. Description
1 External Sleeve Wall
1*a* External Indicia
1*b* Overlap
2 Display Case
2*a* Display Case Shell
2*b* Display Case Base Unit Receptor
3 Base Unit
3*a* External Base Layer
3*b* Ascending Base Structure
3*c* Base Unit Platform
4 Top Unit
4*a* Top External Layer
4*b* Top Depending Section
6 Base Thumb Tab
7 Thumb Tab Receptor
8 Support Spacer
9 Toy or Prize
10 Securing Tray
11*a* Written Indicia
11*b* Molded Indicia
12 Security Tape
100 External Packaging
200 Display Case Unit
300 Closed Package Unit

We claim:

1. A toy packaging and display device comprising:

a. a base unit comprising a solid base unit platform located at the top of said base unit;

b. a display case capable of removably mating with said base unit, thereby forming a display unit when so mated;

c. an external sleeve diametrically larger than the display case;

wherein the external sleeve is capable of removably mating with said base unit;

wherein a first cavity is defined between said external sleeve and said base unit when they are connected; wherein the first cavity houses at least a portion of the display unit, and wherein the display unit defines a second internal cavity which is encapsulated by said first cavity and is capable of housing a toy or prize;

wherein the external sleeve comprises an external wall with at least two openings opposite each other, wherein the base unit removably connects to the external sleeve at one of the said at least one opening; and wherein a top is connected to the external sleeve on the side opposite the base unit thereby forming an external packaging; and wherein gaps are formed between the internal side of the external sleeve and display case, and wherein the toy packaging and display device further comprises at least one spacer to fill at least a portion of a gap between the sleeve and display case.

2. The toy packaging and display device as in claim 1 wherein the display case is at least partially transparent.

3. The toy packaging and display device as in claim 2 wherein the external sleeve is cylindrical.

4. The toy packaging and display device as in claim 2 wherein the external sleeve is comprised of a material selected from the group consisting of plastics, woods, malleable metals, paper, paperboard, cardboard, or combinations thereof.

5. The toy packaging and display device as in claim 2 further comprising at least one securing tray, wherein each said at least one securing tray is in contact with said toy or prize and either the base unit, the display case, or both the base unit and the display case.

6. The toy packaging and display device as in claim 2 wherein the display case is cylindrical in shape and comprises an open end and a closed end opposing the open end.

7. The toy packaging and display device as in claim 1 wherein the external sleeve is at least partially opaque.

8. The toy packaging and display device as in claim 1 wherein the top comprises a depending end and an external end, wherein at least the depending end is shaped to correspond with the shape of the corresponding opening of the external wall, and wherein the depending section is attached to the external wall by an adhesive.

9. The toy packaging and display device as in claim 8 wherein a closed end of the display case is dome shaped.

10. A toy packaging and display device comprising:

a. a base unit, wherein the base unit comprises an external portion and an ascending portion, wherein the external portion is diametrically larger than the ascending portion;

b. a display case comprising an at least partially transparent wall, wherein said display case mates with said base unit at a base unit receptor forming a display case unit when mated;

c. an external sleeve, wherein the external sleeve comprises an external sleeve wall and a top, wherein said external sleeve is capable of mating with said base unit thereby forming an external package, wherein a first cavity is defined between said external sleeve and said base unit to house at least a portion of said display unit so that said first cavity encapsulates a second cavity and wherein said second cavity is defined by said display unit such that a toy or prize is capable of being housed in said second cavity and wherein gaps are formed between the internal side of the external sleeve and display case;

d. at least one securing tray, wherein each said at least one securing tray is in contact with said toy or prize and either the base unit, the display case, or both the base unit and the display case; and e. at least one spacer to fill at least a portion of said gaps between the sleeve and display case.

11. The toy packaging and display device as in claim 10 wherein the external sleeve wall is at least partially opaque.

12. The toy packaging and display device as in claim 10 wherein the external sleeve wall is cylindrical.

13. The toy packaging and display device as in claim 12 wherein the external sleeve unit is comprised of a material selected from the group consisting of plastics, woods, malleable metals, paper, paperboard, cardboard or combinations thereof.

14. The toy packaging and display device as in claim 13 wherein the top comprises a depending section and an external section, wherein at least the depending section is shaped to correspond with the shape of the corresponding opening of the external sleeve wall, and wherein the depending section is attached to the external sleeve wall by an adhesive.

15. The toy packaging and display device as in claim 10 wherein the external sleeve wall comprises two or more openings, wherein the base unit removably connects to the external sleeve at one of the said openings.

16. The toy packaging and display device as in claim 15 wherein the top is connected to the external sleeve wall on the side opposite the base unit thereby forming an external sleeve unit.

17. The toy packaging and display device as in claim 10 wherein the display case is cylindrical in shape and comprises an open end and a closed end opposing the open end.

18. The toy packaging and display device as in claim 17 wherein the closed end of the display case is dome shaped.

* * * * *